US005410325A

United States Patent [19]

Friedrich et al.

[11] Patent Number: 5,410,325

[45] Date of Patent: Apr. 25, 1995

[54] ANTENNA MOUNTING APPARATUS

[75] Inventors: Douglas W. Friedrich, Pekin; Carl A. Kemner, Peoria Heights; N. Keith Lay, Peoria; Joel L. Peterson, East Peoria, all of Ill.

[73] Assignee: Caterpillar Inc., Peoria, Ill.

[21] Appl. No.: 103,369

[22] Filed: Aug. 9, 1993

[51] Int. Cl.[6] ..... H01Q 1/32

[52] U.S. Cl. ..... 343/713; 343/711; 343/882

[58] Field of Search ..... 343/713, 715, 711, 878, 343/880, 882, 888, 892; H01Q 1/32, 1/18

[56] References Cited

U.S. PATENT DOCUMENTS

| | | | |
|---|---|---|---|
| 986,806 | 3/1911 | D'Antonio | 343/882 |
| 1,561,228 | 11/1925 | Hammond, Jr. | 343/709 |
| 4,659,044 | 4/1987 | Armstrong | 343/880 |
| 4,931,809 | 6/1990 | Putman et al. | 343/882 |

FOREIGN PATENT DOCUMENTS

| | | | |
|---|---|---|---|
| 440378A | 8/1991 | European Pat. Off. . | |
| 58-101506 | 6/1983 | Japan | 343/DIG. 1 |
| 61-20402 | 1/1986 | Japan . | |
| 61-61505 | 3/1986 | Japan . | |
| 61-88602 | 5/1986 | Japan . | |
| 62-71307 | 4/1987 | Japan . | |

*Primary Examiner*—Donald Hajec
*Assistant Examiner*—Hoanganh Le
*Attorney, Agent, or Firm*—Stephen L. Noe

[57] ABSTRACT

An apparatus for mounting an antenna assembly to an elevationally movable portion of a vehicle dump bed includes a mountable support member having first and second end portions. The first end portion is fixed to the vehicle bed. The antenna assembly has an active element connected to a first end of a mounting element and a counterweight element connected to a second end of a mounting element. An intermediate portion of the mounting element is connected to the second end portion of the mountable support member. The antenna assembly is therefore free to rotate about at least one axis parallel to the axis of rotation of the elevationally movable dump bed.

9 Claims, 4 Drawing Sheets

ANTENNA MOUNTING APPARATUS

TECHNICAL FIELD

The present invention relates generally to a stabilized mounting device and more specifically to a mounting device for maintaining a predetermined orientation between an antenna assembly and a moving vehicle.

BACKGROUND OF THE INVENTION

Antennas for receiving and transmitting radio frequency or other high frequency electromagnetic signals are typically sensitive to the orientation between the transmitting and receiving antennas. In addition, it is generally advantageous to provide a direct line of sight between the transmitting and receiving antennas with no obstacles interfering with that line of sight. In particular, it is disadvantageous to interpose a metallic member between the transmitting and receiving antennas.

One example of a system in which line of sight and orientation are critical is the use of antenna assemblies in conjunction with the geostationary constellations of artificial satellites for positioning purposes. For example, an antenna assembly mounted on a vehicle must maintain line of sight communication with members of the satellite constellation to provide the best datalink between the satellite members and the vehicle antenna. In addition, the antenna assemblies typically used with vehicles are polarized for operation in a specific orientation with respect to the satellite constellation. Therefore, angular rotation of the antenna assembly relative to the satellite constellation is likewise disadvantageous.

It is known in the art to provide various mechanisms for maintaining antenna assemblies in a specific orientation. Some of the prior art systems include counterweight stabilized antenna assemblies mounted in a gimbaled or multirotational fashion. However, none of the prior art antenna assemblies were specifically designed to deal with the combination of line of sight and rotational orientation problems encountered in the case of an antenna used with a vehicle having a dump bed. Antennas mounted on such vehicles, including large off-road mining vehicles, are typically attached to a cab or other stationary portion of the vehicle. However, elevation of the dump bed on such vehicles interposes a metallic element between the stationary mounted antenna and the satellite constellation. This interferes with the line of sight communication requires for best operation of the antenna assembly. Further, the antenna needs to be stabilized when the dump bed is in the lowered or normal carrying mode to prevent undulations in the ground and ordinary travel vibration from causing the gimbaled antenna to oscillate or vibrate in its mounting.

Attempts have also been made to mount the antenna to the dump bed itself, in such a manner that the antenna is elevated along with the leading edge of the dump bed. Such mounting overcomes the line of sight communication problem but then misorients the antenna as the angular relationship between the edge of the dump bed and the constellation system changes.

The present invention is intended to address and overcome one or more of the problems set forth above. The instant antenna assembly and assembly mount are adapted for connection to the edge of a vehicle dump bed, are gimbaled to maintain a constant. orientation relative to the satellite constellation, and include a damping mechanism specifically designed to overcome the vibration and oscillation caused by driving such a vehicle over rough terrain.

SUMMARY OF THE INVENTION

Apparatus is provided for mounting an antenna assembly to an elevationally movable portion of a vehicle dump bed. The apparatus includes a mountable support member having a first end portion fixedly connected to the vehicle bed. An antenna assembly has an active element connected to the top of a mounting element and a counterweight element connected to the bottom of the mounting element. The mounting element is pivotally connected to the second end portion of the mountable support member.

BEST MODE FOR CARRYING OUT THE INVENTION

Figure 1:
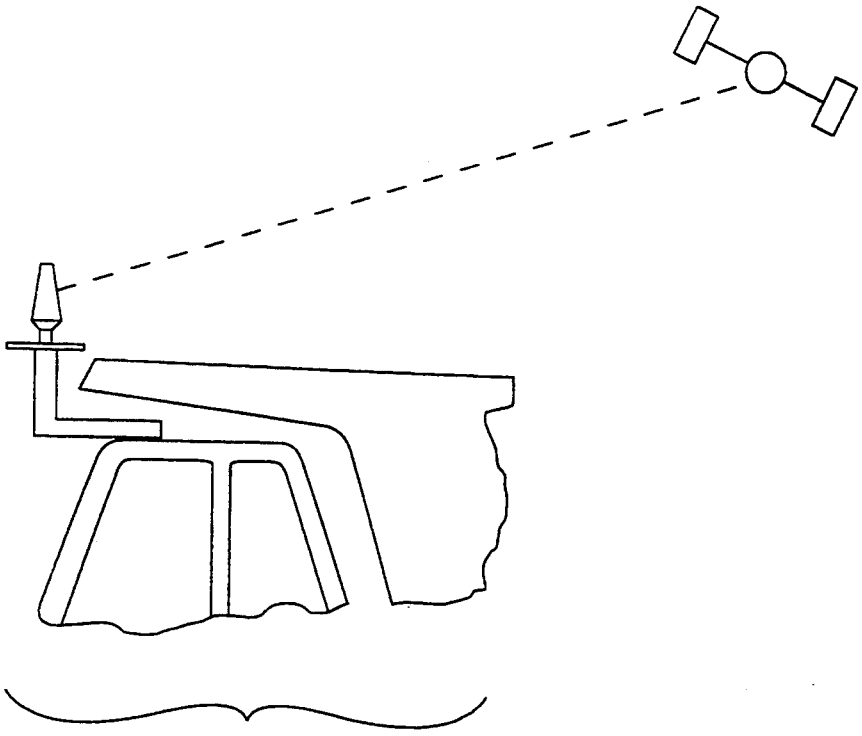
Fig. 1. PRIOR ART
FIG. 1 shows a prior art system in which an antenna assembly is mounted on the cab of a vehicle.
Figure 2:
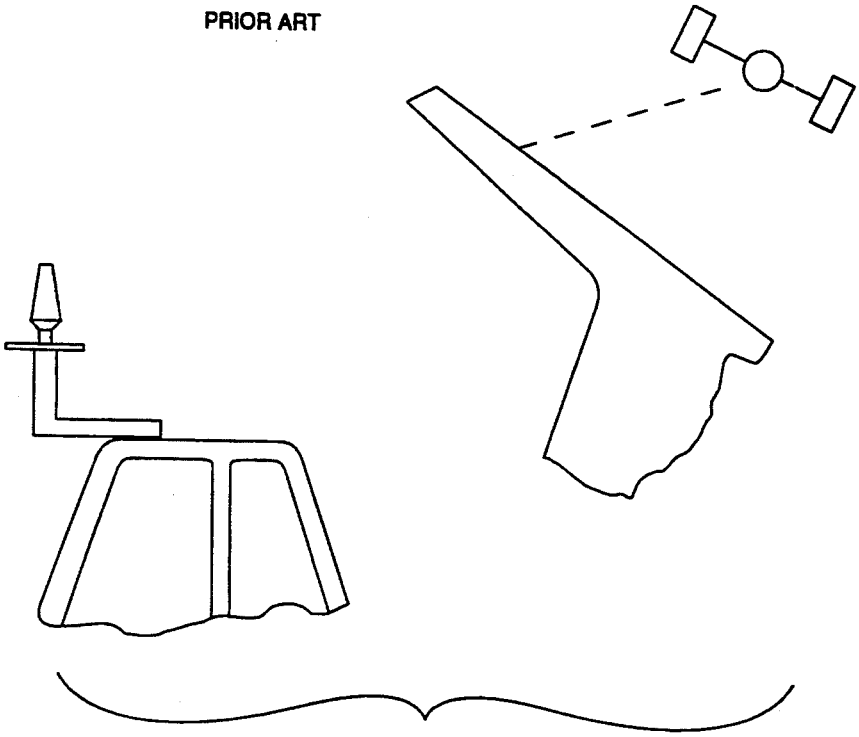
Fig. 2. PRIOR ART
FIG. 2 shows the same prior art antenna assembly with the vehicle bed in a raised position.
Figure 3:
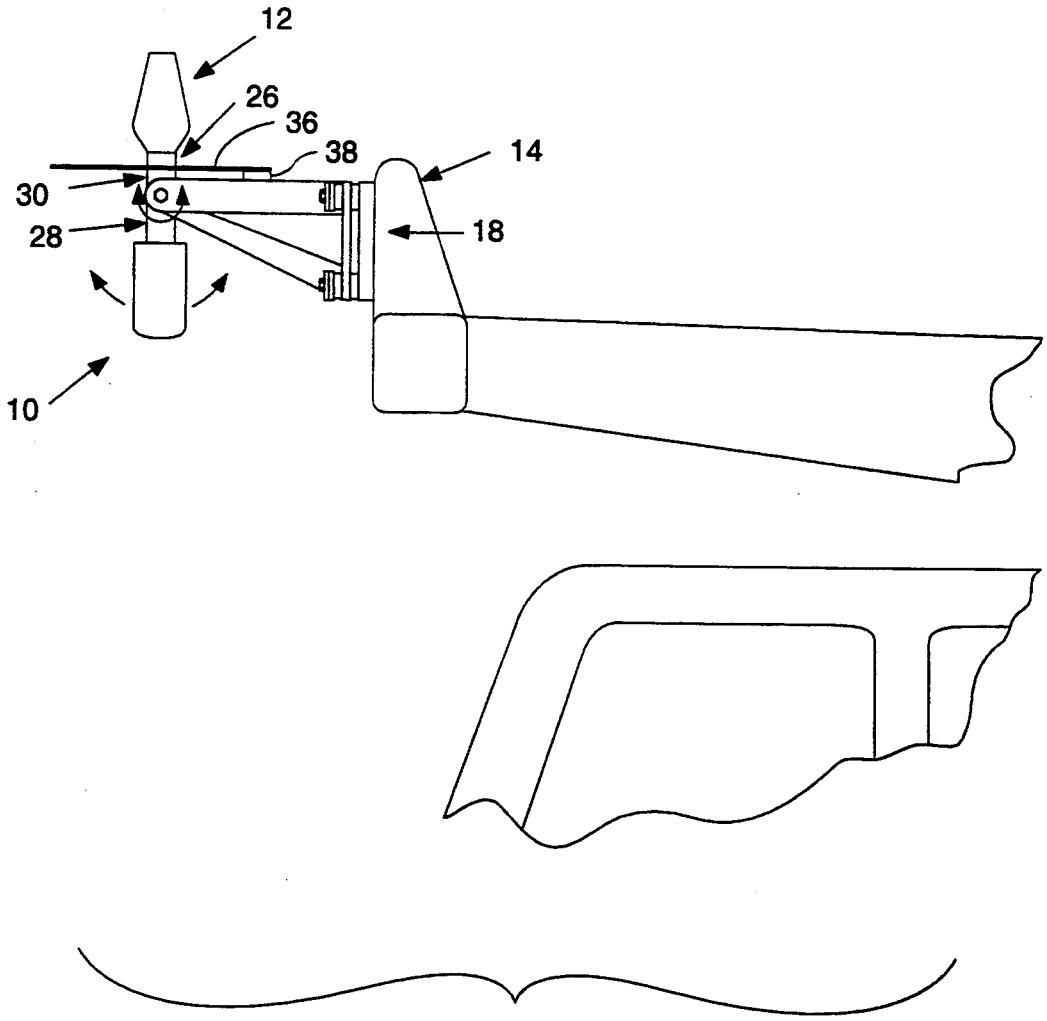
FIG. 3 shows an embodiment of the instant invention with the antenna assembly mounted to the edge of the vehicle dump bed in a normal or lowered position.
Figure 4:
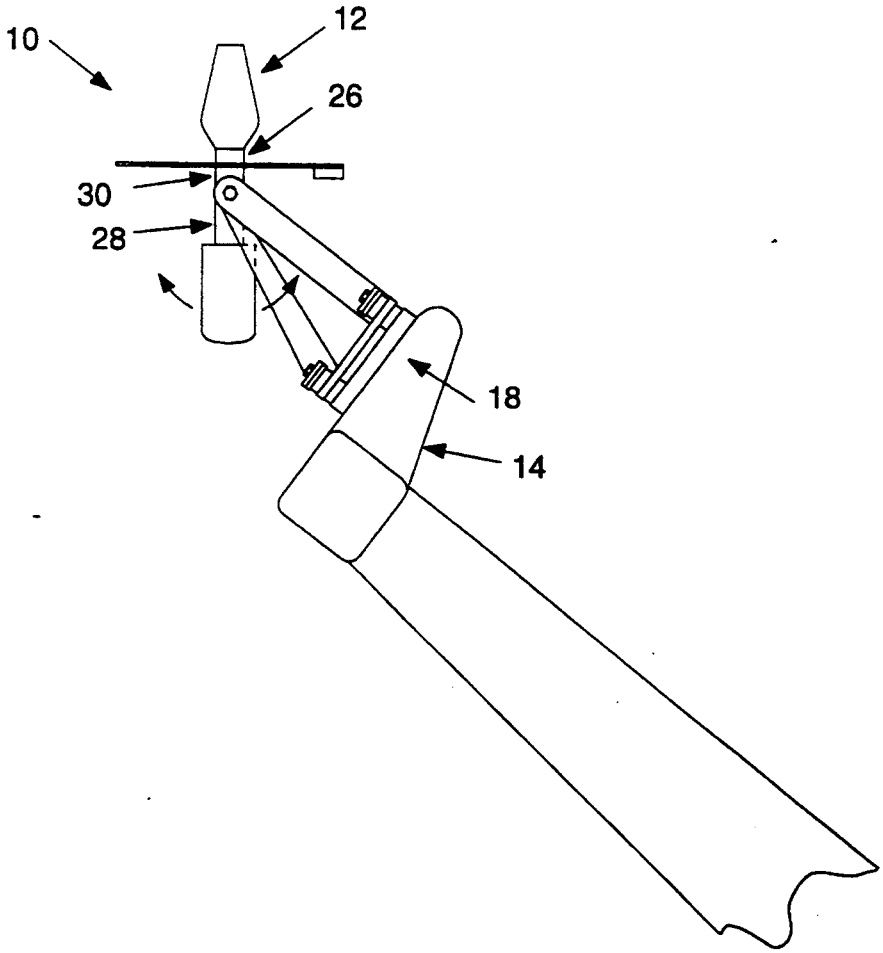
FIG. 4 shows the same embodiment of the instant invention with the antenna assembly mounted to the edge of the dump bed in a raised position.
Figure 4:
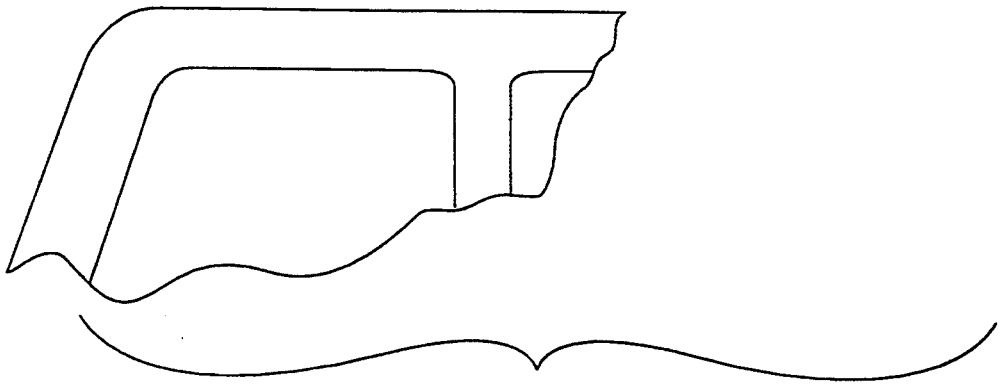
Figure 5:
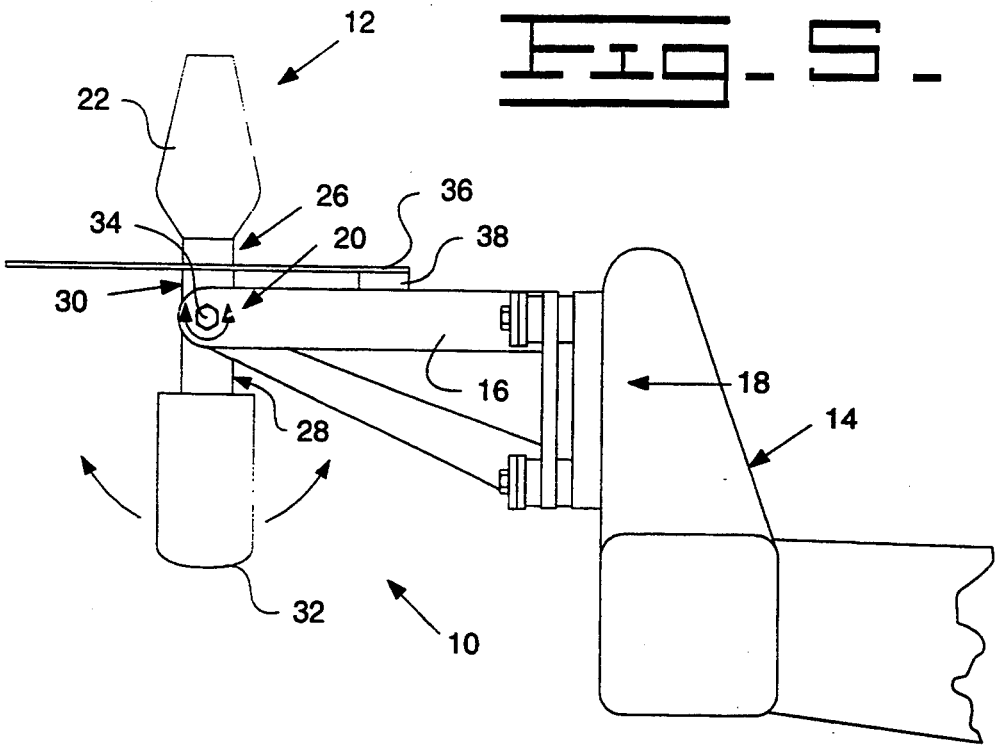
FIG. 5 shows a detailed assembly drawing of a first embodiment of the present invention arranged for motion about a single axis; and, FIG. 6 shows a second embodiment of the present invention arranged for motion about multiple axis.

Referring primarily to FIG. 5, an apparatus 10 is shown to include an antenna assembly 12 connectable to the elevationally movable portion of a vehicle dump bed 14. The assembly 12 includes a mountable support member 16 having first and second end portions 18 and 20. The first end portion 18 is constructed to be fixedly connectable to the vehicle bed 14. This connection can be made in any conventional manner, and is preferably done using threaded bolts to make the antenna assembly 12 easily removable from the vehicle bed 14.

The antenna assembly 12 has an active element 22, a mounting element with top and bottom end portions 26,28 and an intermediate mounting portion 30, and a counterweight element 32. The active element 22 is connected to the mounting element top end portion 26. The active element 22 and the method of connection to the mounting element varies according to the manufacture and design of the actual active element utilized in a particular situation.

The counterweight element 32 is connected to the mounting element bottom end portion 28. The counterweight element 32 is selected to provide sufficient mass to lower the center of gravity of the antenna assembly 12 below the point at which the intermediate mounting portion 30 is connected to the mountable support member 16. The intermediate mounting portion 30 is pivotally connected to the mountable support member second end portion 20. This pivotal connection is about an axis parallel to the axis of rotation of the movable vehicle bed 14.

The preferable method of creating the pivotal mounting connection is for the mounting element intermediate portion 30 to include a through bore fastened to the mountable support member portion 20 with a pin fastener 34. Such a rotatable pin connection is conventional in the mechanical arts.

The antenna assembly 12 includes a damping member 36 fixed to one of the mounting support member 16 and the intermediate mounting portion 30. In FIG. 5 the damping member is shown connected to the intermediate mounting portion 30. A stop element 38 is fixed to the other of the mounting support member 16 and intermediate mounting portion 30. Again, in FIG. 5 the stop element 38 is shown connected to the mounting support member 16. The damping member 36 and stop element 38 are arranged to contact or closely approach one another when the vehicle bed 14 is in its normal or nonelevated position.

Two preferred embodiments of the damping member 36 and stop element 38 include solid damping and stop portions in the case of an actual contact arrangement and magnetic or magnetic and ferrous portions when the two elements are arranged to closely approach one another but not actually contact one another. In this embodiment, magnetic flux flows between the magnetic portion and the ferrous portion maintaining sufficient attraction between the two portions to prevent unwanted oscillation of the antenna assembly 12 about the pivot point while permitting the counterweight 32 to move the antenna assembly 12 when any significant discrepancy exists between the normal lowered vehicle bed position and the instantaneous vehicle bed position.

Figure 6:
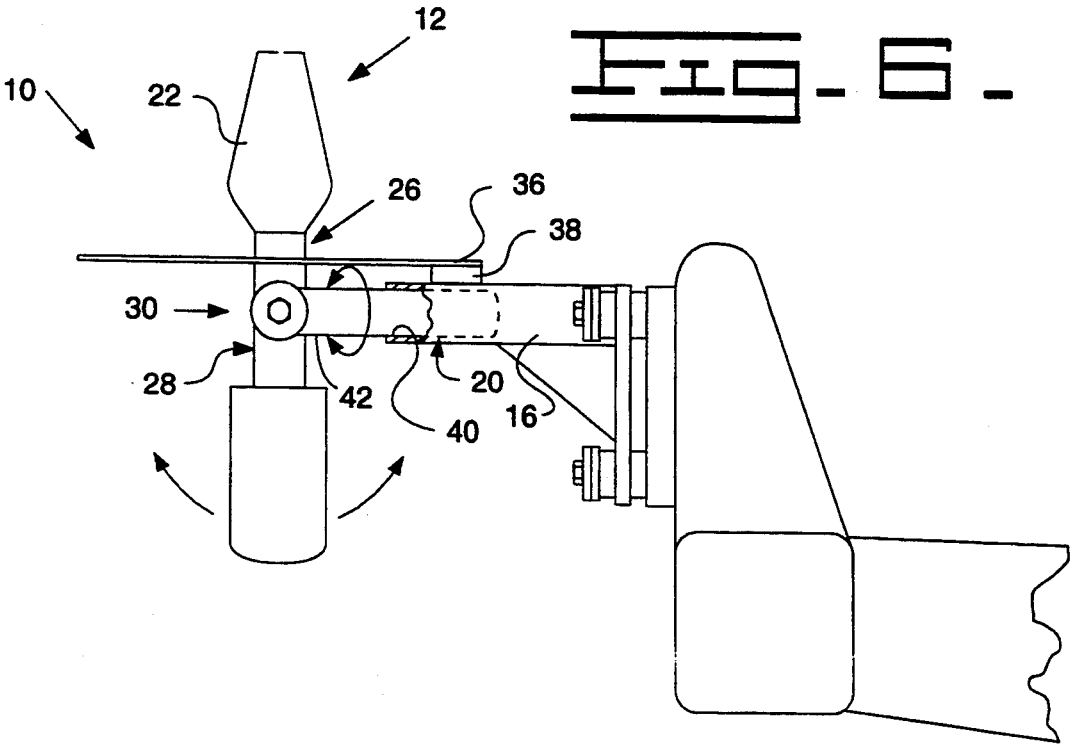

Referring now to FIG. 6, a variation on the embodiment described in FIG. 5 includes a second axis of rotational freedom for situations where vehicle motion about an axis longitudinal to the vehicle is likely to be sufficient to cause misorientation of the antenna assembly 12. In this embodiment, the support member second end portion 20 includes a bore 40 substantially parallel to the axis of the support member 16 and substantially perpendicular to the axis of the vehicle bed 14. In a preferred implementation, a captive insert portion 42 is extendable from the bore 40 and rotatable about the bore axis. The insert portion 42 is pivotally connected to the mounting element intermediate mounting portion 30 substantially as described above. In this embodiment, the insert portion 42 can rotate within the bore 40 about a first axis while the antenna assembly 12 is rotatable about the support member 16 in a second axis. The dual axis of rotation provide a full gimbaled action permitting the antenna assembly 12 to correctly orient itself to the satellite constellation anytime the vehicle bed orientation is disturbed sufficient to cause the damping element to disengage the damping action. Under these circumstances, the counterweight element 32 corrects the antenna 22 position sufficiently to maintain optimal communication with the antenna constellation.

Industrial Applicability

The instant apparatus 10 provides a mechanism for mounting an antenna assembly 12 to an elevationally movable portion of a vehicle dump bed 14. In operation, when the dump bed 14 is raised from its normal lowered carry position to its elevated dump position the antenna assembly 12 swings about a rotational axis maintaining a vertical orientation with respect to the ground and a proper communication orientation with respect to the satellite constellation. At the same time, in the event that the vehicle and attached dump bed 14 are displaced about the axis of the vehicle itself, perpendicular to the axis of rotation of the dump bed 14, the antenna assembly 12 likewise is automatically corrected in its vertical position. This sort of disturbance is likely to occur when the vehicle is operated on rough terrain or on hillsides.

We claim:

1. Apparatus for mounting an antenna assembly to an elevationally movable portion of a vehicle dump bed comprising:

a mountable support member having first and second end portions, said first end portion being fixedly connectable to said vehicle bed;

said antenna assembly having an active element, a mounting element with top and bottom end portions and an intermediate mounting portion, and a counterweight element, said active element being connected to said mounting element top end portion, said counterweight element being connected to said mounting end bottom end portion, and said mounting element intermediate portion being pivotally connected to said mountable support member second end portion; and a damping member fixed to one of said mounting support member and said intermediate mounting portion, and a stop element fixed to the other of said mounting support member and said intermediate mounting portion, said stop element being arranged to operationally engage said damping member when said bed and antenna assembly are in a nonelevated position.

2. Apparatus for mounting an antenna assembly, as set forth in claim 1, wherein said counterweight element is sufficient to cause said antenna assembly center of gravity to be below said mountable support member.

3. Apparatus for mounting an antenna assembly, as set forth in claim 2, wherein said pivotal rotation is about an axis parallel to the axis of rotation of said movable vehicle bed.

4. Apparatus for mounting an antenna assembly, as set forth in claim 3, wherein said mounting element intermediate portion includes a through bore and is fastened to said mountable support member second end portion with a rotatable pin fastener.

5. Apparatus for mounting an antenna assembly, as set forth in claim 4, wherein said support member second end portion includes a bore parallel to the axis of said support member and perpendicular to the axis of said movable vehicle bed and a captive insert portion extendable from said bore and rotatable about said axis, said insert portion being pivotally connected to said mounting element intermediate mounting portion.

6. Apparatus for mounting an antenna assembly, as set forth in claim 1, wherein one of said damping member and said stop element is of a ferrous metallic composition and the other of said damping member and said stop element is magnetic.

7. Apparatus for mounting an antenna assembly to an elevationally movable portion of a vehicle dump bed comprising:

a mountable support member having first and second end portions, said first end portion being fixedly connectable to said vehicle bed;

said antenna assembly having an active element, a mounting element with top and bottom end portions and an intermediate mounting portion including a through bore and fastened to said mountable support member second end portion with a rotatable pin fastener, a counterweight element being sufficient to cause said antenna assembly center of gravity to be below said mountable support member, a damping member, and a stop element; and said active element being connected to said mounting element top end portion, said counterweight element being connected to said mounting element bottom end portion, and said mounting element intermediate portion being pivotally connected to said mountable support member second end portion, said pivotal rotation being about an axis parallel to the axis of rotation of said movable vehicle bed, and said damping member fixed to one of said mounting support member and said intermediate mounting portion, and said stop element fixed to the other of said mounting support member and said intermediate mounting portion, said stop element being arranged to operationally engage said damping member when said bed and antenna assembly are in a nonelevated position.

8. Apparatus for mounting an antenna assembly, as set forth in claim 7, wherein said support member second end portion includes a bore parallel to the axis of said support member and perpendicular to the axis of said movable vehicle bed and a captive insert portion extendible from said bore and rotatable about said axis, said insert portion being pivotally connected to said mounting element intermediate mounting portion.

9. Apparatus for mounting an antenna assembly, as set forth in claim 8, wherein one of said damping member and said stop element is of a ferrous metallic composition and the other of said damping member and said stop element is magnetic.

* * * * *